US009691340B2

(12) United States Patent
Liu et al.

(10) Patent No.: US 9,691,340 B2
(45) Date of Patent: Jun. 27, 2017

(54) POLARITY REVERSION DRIVING METHOD AND APPARATUS OF LIQUID CRYSTAL DISPLAY, AND A LIQUID CRYSTAL DISPLAY

(71) Applicants: BOE TECHNOLOGY GROUP CO., LTD., Beijing (CN); HEFEI BOE OPTOELECTRONICS TECHNOLOGY CO., LTD., Hefei, Anhui (CN)

(72) Inventors: Jinliang Liu, Beijing (CN); Guangyan Tian, Beijing (CN)

(73) Assignees: BOE TECHNOLOGY GROUP CO., LTD., Beijing (CN); HEFEI BOE OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 34 days.

(21) Appl. No.: 14/381,111

(22) PCT Filed: Jun. 18, 2013

(86) PCT No.: PCT/CN2013/077411

§ 371 (c)(1),
(2) Date: Aug. 26, 2014

(87) PCT Pub. No.: WO2014/169515

PCT Pub. Date: Oct. 23, 2014

(65) Prior Publication Data

US 2016/0180783 A1 Jun. 23, 2016

(30) Foreign Application Priority Data

Apr. 15, 2013 (CN) ..... 2013 1 0130258

(51) Int. Cl.
*G09G 3/36* (2006.01)

(52) U.S. Cl.
CPC ..... *G09G 3/3614* (2013.01); *G09G 3/3622* (2013.01); *G09G 3/3688* (2013.01);
(Continued)

(58) Field of Classification Search
CPC .. G09G 3/3614; G09G 3/3611–3/3688; G09G 2310/0254; G09G 2320/0247;
(Continued)

(56) References Cited

U.S. PATENT DOCUMENTS 8,102,351 B2 * 1/2012 Tang ..... G09G 3/2055 345/209
2002/0089485 A1 * 7/2002 Youn ..... G09G 3/3614 345/99

(Continued)

FOREIGN PATENT DOCUMENTS

CN 1530723 A 9/2004
CN 1619400 A 5/2005

(Continued)

OTHER PUBLICATIONS

International Search Report Appln. No. PCT/CN2013/077411; Dated Jan. 23, 2014.

(Continued)

*Primary Examiner* — Sanjiv D Patel
(74) *Attorney, Agent, or Firm* — Ladas & Parry LLP; Loren K. Thompson

(57) ABSTRACT

Polarity reversion driving method and apparatus of liquid crystal display and a liquid crystal display are provided. In the method, four frames constitute one polarity reversion driving period, in which a first frame and a third frame have a same polarity arrangement with reversed polarities; a second frame and a fourth frame have a same polarity arrangement with reversed polarities; the first frame and the second frame have different polarity arrangements and cor- (Continued)

responding pixels in adjacent two frames have complementary charging effects. The apparatus includes a time schedule controller, a logic controller and a source driver. Charging effects of pixels in frames are controlled by setting a polarity arrangement of pixels in each frame so that charging effects of corresponding pixels are complementary in adjacent two frames, thereby relieving the problem of reduced display quality due to inconsistent charging effects of pixels on two sides of data lines.

6 Claims, 4 Drawing Sheets

(52) U.S. Cl.
CPC ..... *G09G 2300/0426* (2013.01); *G09G 2300/0439* (2013.01); *G09G 2310/08* (2013.01); *G09G 2320/0247* (2013.01)

(58) Field of Classification Search
CPC ..... G09G 3/2025; G09G 2320/0252; G09G 3/2022; G09G 2310/0297; G09G 2320/0209
See application file for complete search history.

(56) References Cited

U.S. PATENT DOCUMENTS

2004/0178981 A1 9/2004 Asada et al.
2005/0104834 A1* 5/2005 Tsuchihashi ..... G09G 3/3614 345/96
2005/0206596 A1* 9/2005 Chen ..... G09G 3/3614 345/87
2005/0259067 A1 11/2005 Cheng
2006/0193002 A1 8/2006 Satou et al.
2006/0279506 A1* 12/2006 Choi ..... G09G 3/3614 345/98
2006/0279514 A1* 12/2006 Yokota ..... G09G 3/3688 345/100
2007/0046610 A1* 3/2007 Okuzono ..... G09G 3/3614 345/96
2009/0002291 A1 1/2009 Koo et al.
2010/0315402 A1 12/2010 Hashimoto
2012/0293495 A1* 11/2012 Yeo ..... G09G 3/3614 345/419
2012/0299884 A1 11/2012 Liu

FOREIGN PATENT DOCUMENTS

CN 101334975 A 12/2008
CN 101424805 A 5/2009
CN 102629453 A 8/2012
JP 6271932 A 4/1987
KR 1020010004914 A 1/2001

OTHER PUBLICATIONS

Second Chinese Office Action Appln. No. 201310130258.9; Dated Feb. 4, 2015.
International Preliminary Report on Patentability issued Oct. 20, 2515. PCT/CN2013/077411.
First Chinese Office Action dated Apr. 28, 2013 Appin. No. 201110137048.3.
Second Chinese Office Action dated Dec. 25, 2013; Appin. No. 201110137048.3.
USPTO NFOA dated Sep. 25, 2014 in connection with U.S. Appl. No. 13/479,671.
USPTO FOA dated May 5, 2015 in connection with U.S. Appl. No. 13/479,671.
USPTO NFOA dated Dec. 22, 2015 in connection with U.S. Appl. No. 13/479,671.
USPTO FOA dated Jun. 27, 2016 in connection with U.S. Appl. No. 13/479,671.
USPTO NOA mailed Jan. 5, 2017 in connection with U.S. Appl. No. 13/479,671.

* cited by examiner

POLARITY REVERSION DRIVING METHOD AND APPARATUS OF LIQUID CRYSTAL DISPLAY, AND A LIQUID CRYSTAL DISPLAY

FIELD OF THE INVENTION

The present disclosure relates to liquid crystal display technical field, particularly to a polarity reversion driving method and apparatus of liquid crystal display, and a liquid crystal display.

BACKGROUND

In the prior art polarity reversion driving method of liquid crystal display in dual-gate-line and single-data-line mode, in a same row, sub-pixel electrodes on both sides of each data line are alternately arranged with positive and negative polarities. Due to the RC delay of data lines, the charging effects of sub-pixels on both sides of each data line in the same row will be inconsistent.

In prior art polarity reversion driving methods of liquid crystal display, a scanning and displaying period of two frames is used as one polarity reversion driving period. As shown in FIG. 1, the polarity arrangement for the third and fourth frames corresponds to that for the first and second frames. With the polarity arrangement of the first frame as an example, on the first row, positive electrodes are arranged on the left side of data line n and negative electrodes are arranged on the right side. Due to the RC delay of the data line, sub-pixels of positive electrodes arranged on the left side of data line n in the first row can be charged normally, while sub-pixels of negative electrodes arranged on the right side of data line n are undercharged (as indicated by skew lines in FIG. 1), and charging effects of sub-pixels in other rows are similar to the first row. Therefore, R column of sub-pixels on left side of data line n can be charged normally, G column of sub-pixels on right side of data line n are undercharged, resulting in luminance difference for sub-pixels on two sides of data lines. For the second frame, the polarity arrangement is the same as that of the first frame but with reversed polarities. Similarly, charging effects of sub-pixels on two sides of data lines are inconsistent in that sub-pixels on left side of data line n can be charged normally while sub-pixels on right side of data line n are undercharged, hence impacting the display quality.

SUMMARY

In view of the problems existing in the prior art, the object of the present disclosure is to provide a polarity reversion driving method and apparatus, and a liquid crystal display that can relieve the problem of reduced display quality due to inconsistent charging effects of pixels on two sides of data lines.

In order to achieve the above-mentioned object, in the polarity reversion driving method of a liquid crystal display in an embodiment of the present invention, four frames are used as one polarity reversion driving period in which a first frame and a third frame have a same polarity arrangement with reversed polarities; a second frame and a fourth frame have a same polarity arrangement with reversed polarities; the first frame and the second frame have different polarity arrangement and corresponding pixels in adjacent two frames have complementary charging effects.

For example, any one in the four frames may be used as a starting frame, and images are scanned and displayed in a sequential order or reversed sequential order of the four frames.

For example, polarity arrangement of every frame is repeated with a period of four rows and four columns; sub-pixels in a first row and a second row have same polarities, sub-pixels in a third row and a fourth row have same polarities, and sub-pixels in the first row and the third row have reversed polarities.

For example, sub-pixels in the first column and the fourth column in the first frame have same polarities, sub-pixels in the second column and the third column have same polarities, and sub-pixels in the first column and the second column have reversed polarities; sub-pixels in the first column and the second column in the second frame have same polarities, sub-pixels in the third column and the fourth column have same polarities, and sub-pixels in the first column and the third column have reversed polarities.

For example, in the polarity arrangement of the first frame, polarities of the first column of sub-pixels are positive, positive, negative, negative in turn, and polarities of sub-pixels in the second column are negative, negative, positive, positive in turn; in the polarity arrangement of the second frame, polarities of the first column of sub-pixels are positive, positive, negative, negative in turn, and polarities of sub-pixels in the second column are positive, positive, negative, negative in turn.

For example, polarity arrangement of each frame is repeated with a period of two rows and four columns, and sub-pixels in the first row and the second row have reversed electrodes.

For example, sub-pixels in the first column and the fourth column in the first frame have the same polarities, sub-pixels in the second column and the third column have the same polarities, and sub-pixels in the first column and the second column have reversed polarities; sub-pixels in the first column and the second column in the second frame have same polarities, sub-pixels in the third column and the fourth column have same polarities, and sub-pixels in the first column and the third column have reversed polarities.

For example, in the polarity arrangement of the first frame, polarities of the first column of sub-pixels are positive, negative, positive, negative in turn, and polarities of sub-pixels in the second column are negative, positive, negative, positive in turn; in the polarity arrangement of the second frame, polarities of the first column of sub-pixels are positive, negative, positive, negative in turn, and polarities of sub-pixels in the second column are positive, negative, positive, negative in turn.

A polarity reversion driving apparatus of a liquid crystal display in an embodiment of the present invention comprises a time schedule controller, a logic controller and a source driver, wherein,

- the time schedule controller is configured to transmit a first polarity reversion signal POL1', a second polarity reversion signal POL2' and a control signal to the logic controller;
- the logic controller is configured to select and output the first polarity reversion signal POL1' or the second polarity reversion signal POL2' to the source driver according to a level of the control signal;
- the source driver is configured to output image data signals with corresponding polarities according to high and low level of the first polarity reversion signal POL1' or the second polarity reversion signal POL2';

the first polarity reversion signal POL1' and the second polarity reversion signal POL2' undergo polarity reversion for every two frames, and the control signal undergoes polarity reversion for every frame.

For example, the first polarity reversion signals POL1' in the first and second frames are identical, the second polarity reversion signals POL2' in the first and second frames are identical, the first polarity reversion signals POL1' in the third and fourth frames are identical, the second polarity reversion signals POL2' in the third and fourth frames are identical, and the first polarity reversion signals POL1' in the first and third frames have reversed polarities, the second polarity reversion signal POL2' in the first and third frames have reversed polarities.

For example, the first polarity reversion signal POL1' and the second polarity reversion signal POL2' are repeated with a period of four intervals, and the first polarity reversion signal POL1' is a successive pulse signal of high, low, low, high, high, low, low and high levels; the second polarity reversion signal POL2' is a successive pulse signal of high, high, low, low, high, high, low and low levels; and the control signal of each frame is of high level or low level.

For example, when the control signal is of high level, the logic controller outputs the first polarity reversion signal POL1'; and when the control signal is of low level, the logic controller outputs the second polarity reversion signal POL2'.

A polarity reversion driving apparatus of a liquid crystal display in an embodiment of the present invention comprises a time schedule controller, an inverter, a first logic controller, a second logic controller and a source driver, wherein, the time schedule controller is configured to transmit a first polarity reversion signal POL1 to the inverter and the first logic controller and transmit a second polarity reversion signal POL2 to the first logic controller and the second logic controller;

the inverter is configured to subject the received first polarity reversion signal to polarity reversion to generate a third polarity reversion signal POL3, and transmit the third polarity reversion signal POL3 to the first logic controller;

the first logic controller is configured to get through the received first polarity reversion signal POL1 and the third polarity reversion signal POL3 to constitute a fourth polarity reversion signal POL4 according to a level type of the received second polarity reversion signal POL2, and transmit the fourth polarity reversion signal POL4 to the second logic controller;

the second logic controller is configured to select and output the fourth polarity reversion signal POL4 or the second polarity reversion signal POL2 to the source driver according to a level of the control signal;

the source driver is configured to output image data signals with corresponding polarities according to the level of the fourth polarity reversion signal POL4 or the second polarity reversion signal POL2;

the fourth polarity reversion signal POL4 and the second polarity reversion signal POL2 undergo polarity reversion for every two frames, and the control signal undergoes polarity reversion for every frame.

For example, the first polarity reversion signal POL1 in every frame is identical, the third polarity reversion signal POL3 in every frame is identical, the second polarity reversion signals POL2 in the first and second frames are identical, the second polarity reversion signals POL2 in the third and fourth frames are identical, and the second polarity reversion signals POL2 in the first and third frame have reversed polarities, the fourth polarity reversion signal POL4 in the first and second frames are identical, the fourth polarity reversion signal POL4 in the third and fourth frames are identical, and the fourth polarity reversion signal POL4 in the first and third frames have reversed polarities.

For example, the second polarity reversion signal POL2 is a successive pulse signal of high, high, high, high, low, low, low and low levels; the fourth polarity reversion signal POL4 is a successive pulse signal of high, low, high, low, low, high, low, and high levels; the control signal of each frame is of high level or low level.

For example, when the control signal is of high level, the second logic controller outputs the fourth polarity reversion signal POL4; and when the control signal is of low level, the second logic controller outputs the second polarity reversion signal POL2.

The liquid crystal display of an embodiment of the present invention includes the above-mentioned polarity reversion driving apparatus of a liquid crystal display.

In embodiments of the present invention, charging effects of pixels in frames are controlled by setting polarity arrangements of pixels in each frame so that charging effects for corresponding pixels in adjacent two frames are complementary, thereby relieving the problem of reduced display quality due to inconsistent charging effects of pixels on two sides of data lines.

BRIEF DESCRIPTION OF DRAWINGS

In order to clearly illustrate the technical solution of the embodiments of the invention, the drawings of the embodiments will be briefly described in the following. It is obvious that the drawings are only related to some embodiments of the invention and thus are not limitative of the invention.

EXPLANATION OF REFERENCE NUMERALS

1, 2 denote one polarity reversion driving period of embodiment 1 and embodiment 2, respectively; 3 denotes data signal scanning sequence; and 4 denotes data signal line.

DETAIL DESCRIPTION

In order to make objects, technical details and advantages of the embodiments of the invention apparent, the technical solutions of the embodiments will be described in a clearly and fully understandable way in connection with the drawings related to the embodiments of the invention. Apparently, the described embodiments are just a part but not all of the embodiments of the invention. Based on the described embodiments herein, those skilled in the art can obtain other embodiment(s), without any inventive work, which should be within the scope of the invention.

Unless otherwise defined, all the technical and scientific terms used herein have the same meanings as commonly understood by one of ordinary skill in the art to which the present invention belongs. The terms such as "a" "an" or "the" etc., are not intended to limit the amount, but indicate the existence of at lease one. The terms "comprises," "comprising," "includes," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
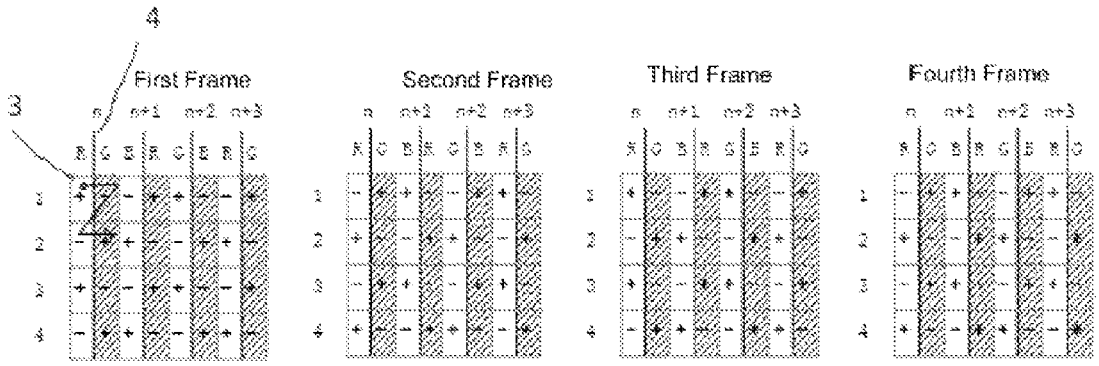
FIG. 1 is a schematic diagram of polarity arrangement for each frame in prior art polarity reversion driving method.

In prior art polarity reversion driving method of liquid crystal display, the polarity arrangement of each frame is shown in FIG. 1. The process of two frames' scanning and displaying is treated as one polarity reversion driving period. The polarity arrangements for the first frame and the third frame are the same, the polarity arrangements for the first frame and the second frames correspond to each other with reversed polarities. Taking the polarity arrangement of the first frame as an example, in the first row, positive electrodes are arranged in R column on left side of data line n, negative electrodes are arranged in G column on right side of data line n. Due to the RC delay of the data line, sub-pixels with positive electrodes arranged on left side of data line n in the first row may be charged normally, while sub-pixels with negative electrodes arranged on right side of data line n may be undercharged (as shown by skew lines in FIG. 1). Arrangements on left and right sides of data lines n in other rows are corresponding positive and negative polarities too, resulting in charging effects of sub-pixels in other rows similar to that of the first row. Therefore, R column of sub-pixels on left side of data line n may be charged normally, while G column of sub-pixels on right side of data line n may be undercharged, resulting in luminance difference for sub-pixels on left and right sides of the data lines, and hence influencing display quality.

In order to make the idea of the present disclosure thoroughly understood, description will be given below by way of exemplary embodiments.

Embodiment 1

Figure 2:
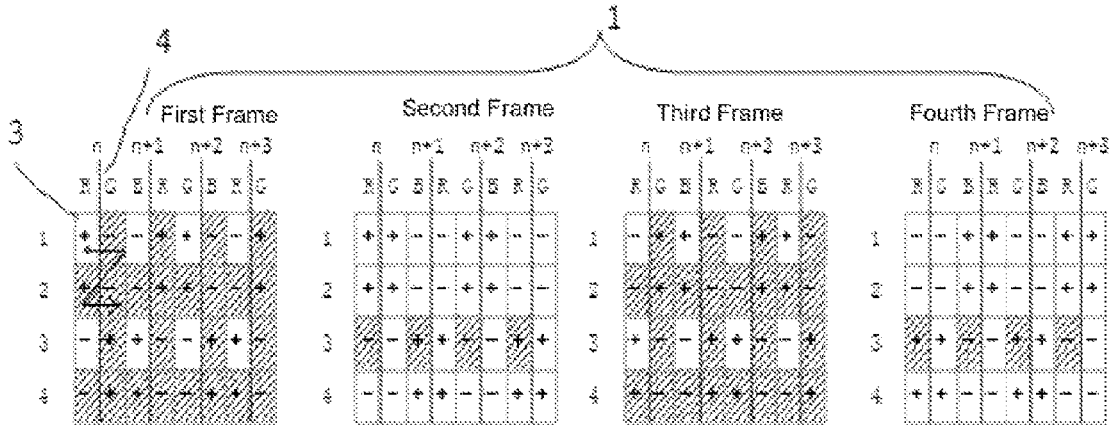
FIG. 2 is a schematic diagram of one polarity reversion driving period and pixels polarity arrangement corresponding to frames of the polarity reversion driving method of embodiment 1 of the present invention.

As shown in FIG. 2, in the polarity reversion driving method of an embodiment of the present invention, one polarity reversion period 1 includes four frames in which the first and third frames have corresponding pixel polarity arrangements with reversed polarities; the second and fourth frames have corresponding pixel polarity arrangements with reversed polarities; and the polarity arrangements for the first and second frames are different. In the process of scanning and displaying images, the first frame is adjacent to the second frame, the second frame is adjacent to the third frame, the third frame is adjacent to the fourth frame, and any one of the four frames can serve as a starting frame to scan and display images in the order or reversed sequential order of the four frames.

According to the above-mentioned polarity reversion driving method, the polarity arrangement of each frame is repeated with a period of four rows and four columns. Sub-pixels in the first row and the second row have the same polarities, sub-pixels in the third row and the fourth row have the same polarities, and sub-pixels in the first row and the third row have reversed polarities. Sub-pixels in the first column and the fourth column in the first frame have the same polarities, sub-pixels in the second column and the third column have the same polarities, and sub-pixels in the first column and the second column have reversed polarities. Sub-pixels in the first column and the second column in the second frame have the same polarities, sub-pixels in the third column and the fourth column have the same polarities, and sub-pixels in the first column and the third column have reversed polarities. In the polarity arrangement of the first frame, polarities of the first column of sub-pixels are positive, positive, negative, negative in turn, and polarities of sub-pixels in the second column are negative, negative, positive, positive in turn. In the polarity arrangement of the second frame, polarities of the first column of sub-pixels are positive, positive, negative, negative in turn, and polarities of sub-pixels in the second column are positive, positive, negative, negative in turn.

With the above-mentioned polarity arrangement, it is possible to have a result in which in the first frame, G column of sub-pixels on the right side of the data signal line n are undercharged, and even numbered rows of R column of sub-pixels are undercharged (parts with skew lines in the schematic diagram), and for normally-white mode, their brightness is larger than odd numbered rows of R column of sub-pixels that are normally charged. In the second frame, even numbered rows of R column of sub-pixels and G column of sub-pixels corresponding to the data signal line n may be charged normally, and odd numbered rows of R column of sub-pixels are undercharged (parts with skew lines in the schematic diagram), their brightness is complementary to that of the first frame of the data signal line n exactly, and time average makes the brightness of R column and G column of sub-pixels perceived consistent in visual effect and results in a uniform picture. As to the third and the fourth frames, with a principle same as that for the first and second frames, the brightness of pixel columns undercharged can compensates for each other between two adjacent frames, and poor quality of V-line (vertical line) will not be formed visually. If prior art polarity reversion driving is used, that is, the polarity arrangement of the first frame and the polarity arrangement of the third frame alternately drive, or the polarity arrangement of the second frame and the polarity arrangement of the fourth frame alternately drive the liquid crystal panel to display, its sub-pixels of G column are always brighter than sub-pixels of R column and V-line phenomenon would occur visually.

Figure 3:
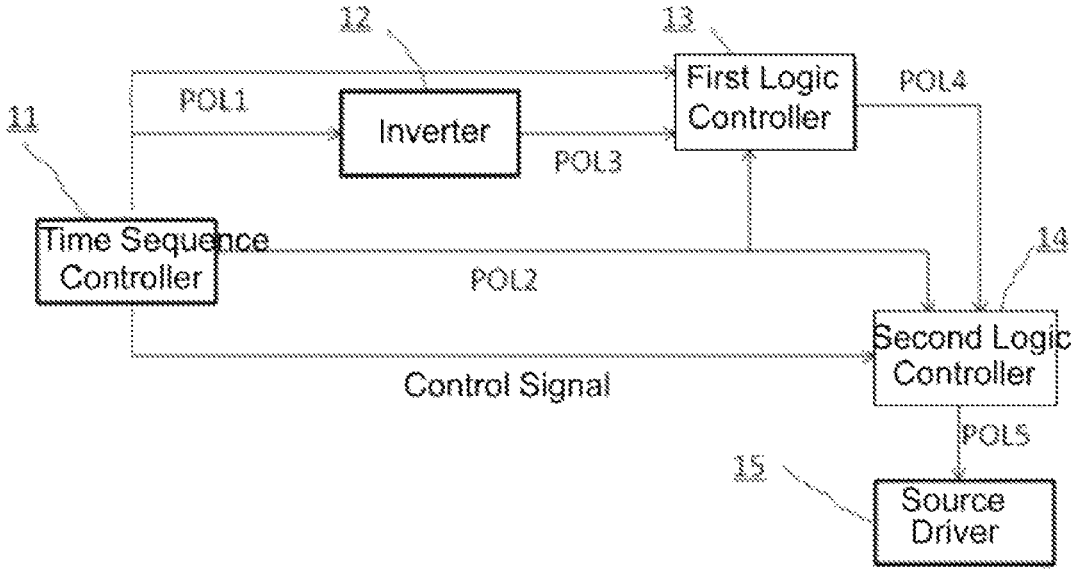
FIG. 3 is a schematic diagram of a polarity reversion driving apparatus of polarity reversion signals for realizing the pixel polarity arrangement in FIG. 2.

FIG. 3 is a polarity reversion driving apparatus for implementing the polarity reversion driving method shown in FIG. 2, with the purpose of generating four polarity arrangement patterns of four frames in FIG. 2 in turn during scanning and displaying process. The polarity reversion driving apparatus includes a time schedule controller 11, an inverter 12, a first logic controller 13, a second logic controller 14 and a source driver 15 in which the time schedule controller 11 generates polarity reversion signals POL1 and POL2 and transmits the polarity reversion signal POL1 to the inverter 12 and the first logic controller 13 and transmits the polarity reversion signal POL2 to the first logic controller 13 and the second logic controller 14. The inverter 12 generates a polarity reversion signal POL3 by polarity reversing the polarity reversion signal POL1 and transmits the polarity reversion signal POL3 to the first logic controller 13. The first logic controller 13 selectively outputs polarity reversion signals POL1 and POL3 to form a polarity reversion signal POL4 under the control of the polarity reversion signal POL2, and polarity reversion signals POL4 and POL2 are output alternately by the second logic controller 14 under the control of the control signal output from the time schedule controller 11 to generate a polarity reversion signal POL5, wherein the polarity reversion signal POL5 herein is the polarity reversion signal POL4 or polarity reversion signal POL2, and the source driver 15 outputs positive and negative polarized image data signals according to the arrangement pattern of four-frame-four-polarity with respect to the common electrode voltage depending on the polarity reversion signal POL5. When the polarity reversion signal POL2 is of high level, the first logic controller 13 gets through the polarity reversion signal POL1, and when the polarity reversion signal POL2 is of low level, the first logic controller 13 gets through the polarity reversion signal POL3. When the control signal output by the time schedule controller 11 is of high level, the polarity reversion signal POL5 output by the second logic controller 14 is the polarity reversion signal POL4, and when the control signal is of low level, the polarity reversion signal POL5 output by the second logic controller 14 is the polarity reversion signal POL2. The polarity reversion signal POL1 output by the time schedule controller 11 does not reverse its polarity with the frame. For the polarity reversion signal POL2, polarity reversion occurs for every two frames, and for the control signal, the polarity reversion occurs for every one frame.

Figure 4:
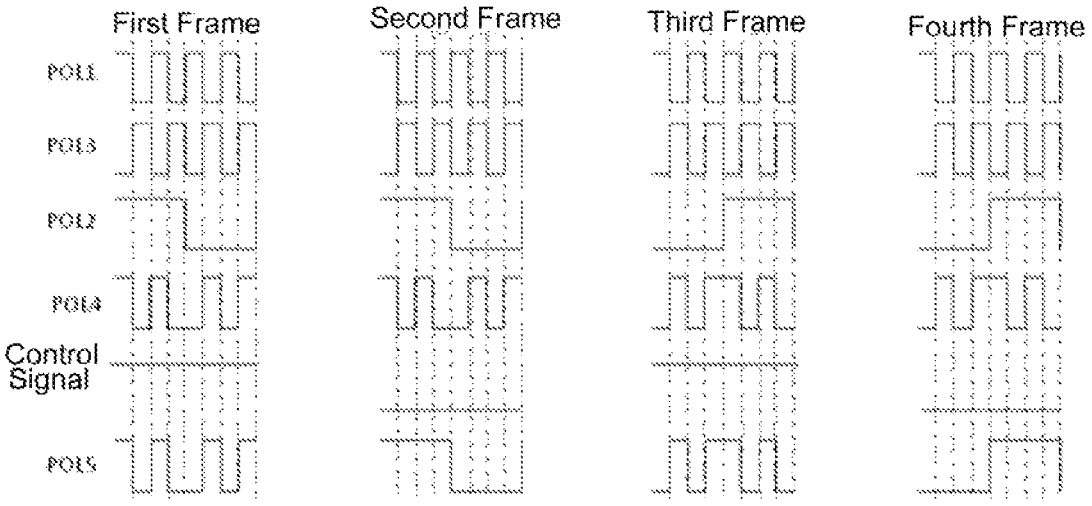
FIG. 4 is a schematic diagram of polarity reversion signal sequence for realizing pixel polarity arrangement corresponding to frames in one polarity reversion driving period in embodiment 1.

The time sequence waveform of every four frames for the above-mentioned polarity reversion signals POL1, POL2, POL3, POL4 and POL5 and the control signal is shown in FIG. 4, wherein the polarity reversion signal POL1 for each frame is identical. Since the polarity reversion signal POL3 and the polarity reversion signal POL1 have reversed polarities, the polarity reversion signal POL3 for each frame is identical, that is, the polarity reversion signal POL1 is a successive pulse signal of high, low, high, low, high, low, high, and low level, and on the contrary, the polarity reversion signal POL3 is a successive pulse signal of low, high, low, high, low, high, low and high level. The first ½ period of the second polarity reversion signal POL2 is of high level, and the last ½ period is of low level. Therefore, in the first ½ period, the first logic controller 13 passes the polarity reversion signal POL1, then the first ½ period of the polarity reversion signal POL4 is high, low, high and low level, while the last ½ period of the second polarity reversion signal POL2 is of low level, then the last ½ period of the polarity reversion signal POL4 is of low, high, low and high level, and the finally resulted polarity reversion signal POL4 is a successive pulse signal of high, low, high, low, low, high, low and high levels.

Embodiment 2

Figure 5:
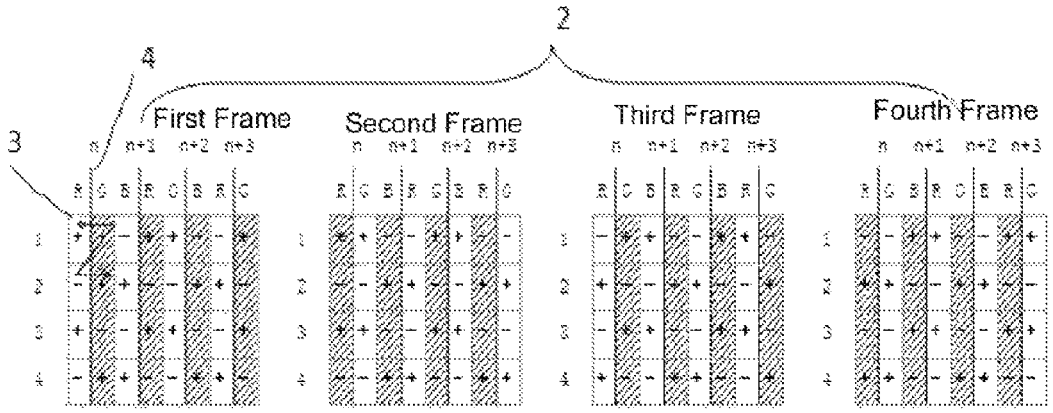
FIG. 5 is a schematic diagram of one polarity reversion driving period and pixel polarity arrangement corresponding to frames in embodiment 2 of the present invention.

As shown in FIG. 5, in another polarity reversion driving method of an embodiment of the present invention, one polarity reversion period 1 includes four frames in which the first and third frames have corresponding pixel polarity arrangements with reversed polarities; the second and fourth frames have corresponding pixel polarity arrangements with reversed polarities; and the polarity arrangements for the first and second frames are different. In the process of scanning and displaying images, the first frame is adjacent to the second frame, the second frame is adjacent to the third frame, the third frame is adjacent to the fourth frame, and any one of the four frames can serve as the starting frame to scan and display images in a sequential order or reversed sequential order of the four frames.

According to the above-mentioned polarity reversion driving method, the polarity arrangement of each frame is repeated with a period of two rows and four columns, with sub-pixels in the first row and the second row having reversed polarities. In the first frame, sub-pixels in the first column and the fourth column have the same polarities, sub-pixels in the second column and the third column have the same polarities, and sub-pixels in the first column and the second column have reversed polarities. In the second frame, sub-pixels in the first column and the second column have the same polarities, sub-pixels in the third column and the fourth column have the same polarities, and sub-pixels in the first column and the third column have reversed polarities. In the polarity arrangement of the first frame, polarities of sub-pixels in the first column are positive, negative, positive and negative in turn, and polarities of sub-pixels in the second column are negative, positive, negative and positive in turn. In the polarity arrangement of the second frame, polarities of sub-pixels in the first column are positive, negative, positive, negative in turn, and polarities of sub-pixels in the second column are positive, negative, positive, negative in turn.

The above-mentioned polarity arrangement will result in that in the first frame, sub-pixels in G column which is associated with the data signal line n are undercharged (parts with skew lines in the schematic diagram), for normally-white mode, sub-pixels in G column are brighter than sub-pixels in R column that are normally charged. For data signal lines n+1, n+2 etc., similarly, sub-pixels in R column, B column corresponding to those signal lines will be brighter than sub-pixels in B column and G column. In traditional methods, two frames constitute one polarity reversion period, as shown in FIG. 1, V-line phenomenon of fixed every other column of sub-pixels would occur for the first and third frame or the second and the fourth frame. Instead, according to embodiments of the present invention, four frames constitute one polarity reversion period, undercharge of the polarity arrangement of the second frame exactly complements with that of the first frame in terms of brightness. Therefore with respect to the time average brightness of the entire picture, the picture brightness is uniform among sub-pixels, and V-line phenomenon would not occur. As to the third and the fourth frames, with a principle same as that for the first and second frames, the brightness of pixel columns undercharged can compensates with each other between two adjacent frames, and poor quality of V-line will not be formed visually.

Figure 6:
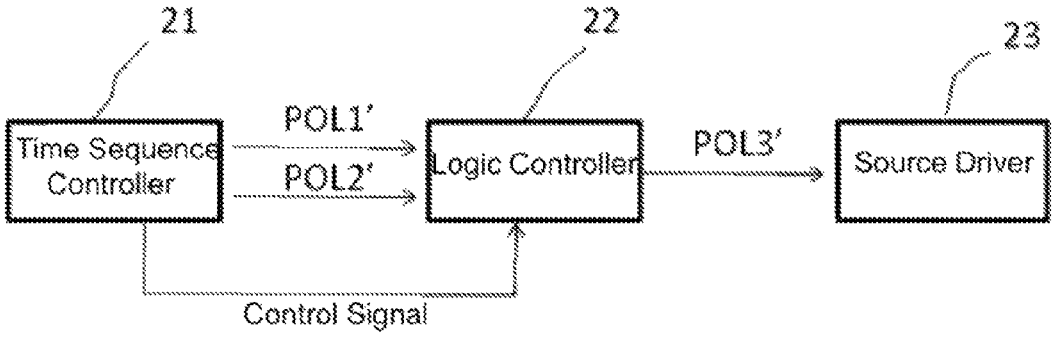
FIG. 6 is a schematic diagram of a polarity reversion driving apparatus of polarity reversion signals for realizing the pixel polarity arrangement in FIG. 5.

FIG. 6 illustrates a polarity reversion driving apparatus for implementing the polarity reversion driving method as shown in FIG. 5, with the purpose of generating four polarity arrangement patterns of four frames in FIG. 5 in turn during scanning and displaying process. The polarity reversion driving apparatus includes a time schedule controller 21, a logic controller 22 and a source driver 23. The time schedule controller 11 generates polarity reversion signals POL1', POL2' and a control signal, and transmits the polarity reversion signals POL1', POL2' and the control signal to the logic controller 22. The logic controller 22, under the control of the control signal, selects the polarity reversion signal POL1' or POL2' and outputs the polarity reversion signal POL3' to the source driver 23, wherein the polarity reversion signal POL3' may be the polarity reversion signal POL1' or the polarity reversion signal POL2'. The source driver 23 outputs image data signals with positive and negative polarities according to the four-frame-four-type polarity arrangement pattern with respect to common electrode voltage depending on the waveform of the polarity reversion signal POL3'. When the control signal output by the time schedule controller 21 is of high level, the polarity reversion signal POL3' output by the logic controller 22 is the polarity reversion signal POL1', and when the control signal is of low level, the polarity reversion signal POL3' output by the logic controller 22 is the polarity reversion signal POL2'. The polarity reversion signal POL1' and the polarity reversion signal POL2' output by the time schedule controller 21 undergo polarity reversion every two frames, and the control signal undergoes polarity reversion every one frame.

Figure 7:
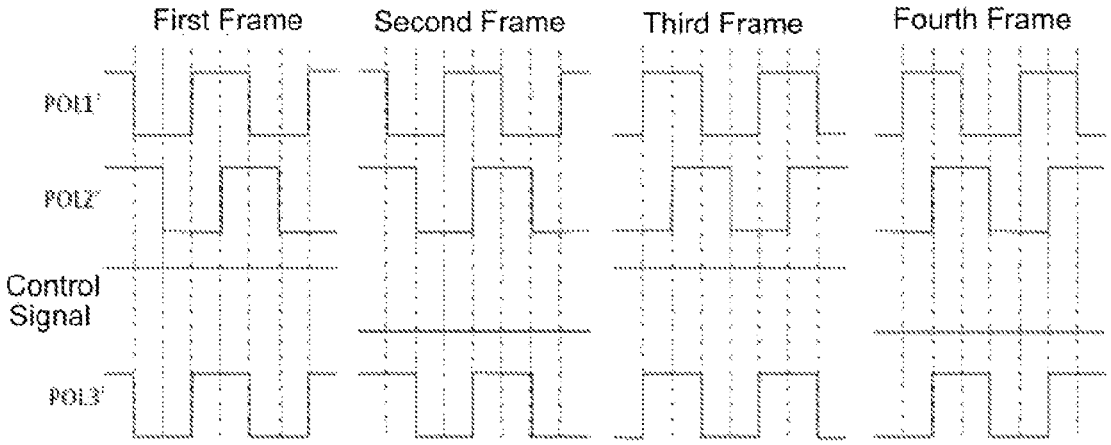
FIG. 7 is a schematic diagram of polarity reversion signal sequence for realizing pixel polarity arrangement corresponding to frames in one polarity reversion driving period in embodiment 2.

The time sequence waveforms for every four frames of the above-mentioned polarity reversion signals POL1', POL2', POL3' and the control signal are shown in FIG. 7, in which the first polarity reversion signals POL1' in the first and second frames are identical, the second polarity reversion signals POL2' in the first and second frames are identical, the first polarity reversion signals POL1' in the third and fourth frames are identical, the second polarity reversion signals POL2' in the third and fourth frames are identical, and the first polarity reversion signals POL1' in the first and third frames have reversed polarities, and the second polarity reversion signals POL2' in the first and third frames have reversed polarities. The first polarity reversion signal POL1' is a successive pulse signal of high, low, low, high, high, low, low and high levels. The second polarity reversion signal POL2' is a successive pulse signal of high, high, low, low, high, high, low and low levels. The control signal of each frame is of high level or low level.

The liquid crystal display of the present disclosure includes the polarity reversion driving apparatus in embodiment 1 or embodiment 2.

What are described above is related to the illustrative embodiments of the disclosure only and not limitative to the scope of the disclosure; the scopes of the disclosure are defined by the accompanying claims.

The invention claimed is:

1. A polarity reversion driving method of a liquid crystal display, in which four frames constitute one polarity reversion driving period, wherein a first frame and a third frame have a same polarity arrangement with reversed polarities, a second frame and a fourth frame have a same polarity arrangement with reversed polarities, the first frame and the second frame have different polarity arrangements and corresponding pixels in adjacent two frames have complementary charging effects, wherein polarity arrangement of every frame is repeated with a period of four rows and four column, and wherein sub-pixels in a first row and a second row have same polarities, sub-pixels in a third row and a fourth row have same polarities, and sub-pixels in the first row and the third row have reversed polarities, and wherein, in the first frame, sub-pixels in a first column and a fourth column have same polarities, sub-pixels in a second column and a third column have same polarities, and sub-pixels in the first column and the second column have reversed polarities; and wherein, in the second frame, sub-pixels in the first column and the second column have same polarities, sub-pixels in the third column and the fourth column have same polarities, and sub-pixels in the first column and the third column have reversed polarities.

2. The polarity reversion driving method of the liquid crystal display of claim 1, wherein any one in the four frames may serve as a starting frame, and images are scanned and displayed in a sequential order or reversed sequential order of the four frames.

3. The polarity reversion driving method of the liquid crystal display of claim 1, wherein in the polarity arrangement of the first frame, polarities of sub-pixels in the first column are positive, positive, negative, negative in turn, and polarities of sub-pixels in the second column are negative, negative, positive, positive in turn; in the polarity arrangement of the second frame, polarities of the sub-pixels in the first column are positive, positive, negative, negative in turn, and polarities of the sub-pixels in the second column are positive, positive, negative, negative in turn.

4. The polarity reversion driving method of the liquid crystal display of claim 1, wherein polarity arrangement of each frame is repeated with a period of two rows and four column, and sub-pixels in a first row and a second row have reversed polarities.

5. The polarity reversion driving method of the liquid crystal display of claim 4, wherein, in the first frame, sub-pixels in a first column and a fourth column have the same polarities, sub-pixels in a second column and a third column have the same polarities, and sub-pixels in the first column and the second column have reversed polarities; and wherein, in the second frame, sub-pixels in the first column and the second column have same polarities, sub-pixels in the third column and the fourth column have same polarities, and sub-pixels in the first column and the third column have reversed polarities.

6. The polarity reversion driving method of the liquid crystal display of claim 5, wherein in the polarity arrangement of the first frame, polarities of sub-pixels in the first column are positive, negative, positive, negative in turn, and polarities of sub-pixels in the second column are negative, positive, negative, positive in turn; in the polarity arrangement of the second frame, polarities of sub-pixels in the first column are positive, negative, positive, negative in turn, and polarities of sub-pixels in the second column are positive, negative, positive, negative in turn.

* * * * *